US005150156A

United States Patent [19]

Koyama

[11] Patent Number: 5,150,156

[45] Date of Patent: Sep. 22, 1992

[54] ELECTROSTATIC IMAGE RECORDING MACHINE CAPABLE OF MULTIPLE GRADATIONS

[75] Inventor: Haruo Koyama, Yawata, Japan

[73] Assignee: Mita Industrial Co., Ltd., Osaka, Japan

[21] Appl. No.: 611,783

[22] Filed: Nov. 13, 1990

[30] Foreign Application Priority Data

Nov. 30, 1989 [JP] Japan ..... 1-313647

[51] Int. Cl.[5] ..... G03G 21/00

[52] U.S. Cl. ..... 355/214; 355/218; 355/229

[58] Field of Search ..... 355/214, 218, 246, 229, 355/230, 244

[56] References Cited

U.S. PATENT DOCUMENTS 4,537,490 8/1985 Stoudt et al. .
4,740,818 4/1988 Tsilibes et al. .
4,794,421 12/1988 Stoudt et al. .
4,905,045 2/1990 Sasaki et al. ..... 355/229
4,963,933 10/1990 Brownlee ..... 355/218

*Primary Examiner*—Richard L. Moses
*Attorney, Agent, or Firm*—Beveridge, DeGrandi & Weilacher

[57] ABSTRACT

An image recording machine for producing a high quality image both in a text part and in a photograph part, i.e., a crisp (low gradation) image in a text part and a gentle (high gradation) image in a photograph part. The gradation characteristic is altered from part to part within a sheet on which the image is produced by decreasing the voltage of the photoconductive drum previously charged at a preset full voltage within a limited area. Irradiation of less intense light onto the photoconductive drum within the limited area by an array of LED elements can be used to decrease the surface voltage.

8 Claims, 4 Drawing Sheets

ELECTROSTATIC IMAGE RECORDING MACHINE CAPABLE OF MULTIPLE GRADATIONS

BACKGROUND

The present invention relates to an electrostatic image recording machine such as a plain paper copier or a printer, and an electrostatic image recording method.

When an original including both a letter text part and a photograph part (such as a page of newspaper) is copied by an electrostatic copying machine, it is difficult to obtain an exact reproduction of the original for the both parts. When the text part is intended to be reproduced correctly, the $\gamma$-value (the slope of the characteristic curve relating the density of the copy image to that of the original) should be large in order to obtain a crisp (i.e., high gradation) image with a clear background. When the photograph part is intended to be reproduced correctly, the $\gamma$-value should be near the unity (1) to obtain a gentle (low gradation) image with a wide dynamic range.

The Japanese Published Unexamined Patent Application No. S63-234269 discloses an image recording machine in which the gradation can be varied in a copy. The prior art image recording machine makes a copy of an original by performing the normal copying cycle twice. After the operator designates a part (or parts) of an original (e.g., a photograph part) where the gradation should be varied from the other part, the first copying cycle is performed. In the first copying cycle, the part of the drum surface corresponding to the designated part is discharged, and the copying conditions are adjusted to the text copying mode (i.e., the $\gamma$-value is made large to obtain a low gradation image). The image on the drum is transferred to the copying sheet. Then the second copying cycle begins with the photograph copying mode (i.e., the $\gamma$-value is made smaller to obtain a high gradation image). This time, the part of the drum corresponding to the text part (i.e., the part other than the designated part) is discharged. The prior art image recording machine uses an array of light emitting elements to discharge a part of the drum surface.

As easily seen, since the prior art image recording machine performs two copying cycles for a copy, it takes longer time to make a copy including a text part and a photograph part. Another problem of the prior art image recording machine is that the two images (text image and photograph image) transferred to a copying sheet can be displaced to each other.

SUMMARY OF THE INVENTION

An object of the present invention is, therefore, to provide an electrostatic image recording machine that can make an image with different gradations from part to part on a sheet in one image recording process.

Another object of the present invention is to make a copying machine that can correctly reproduce both the text part and the photograph part in a shorter time and without displacement between the parts.

In a image recording machine according to the present invention, a latent image corresponding to an original to be recorded is produced on a photoconductive material previously charged at a full voltage, and the latent image is made visible by a developer. The image recording machine of the present invention comprises means for designating a part of the original (such as an edit board described later), and means for decreasing the voltage of the photoconductive material within the designated area from the full voltage (such as an array of LED elements bundled in an array as described later). Other features of the invention is fully described in the description of the embodiment.

BRIEF DESCRIPTION OF THE ATTACHED DRAWINGS

DETAILED DESCRIPTION OF PREFERRED EMBODIMENTS

Figure 1:
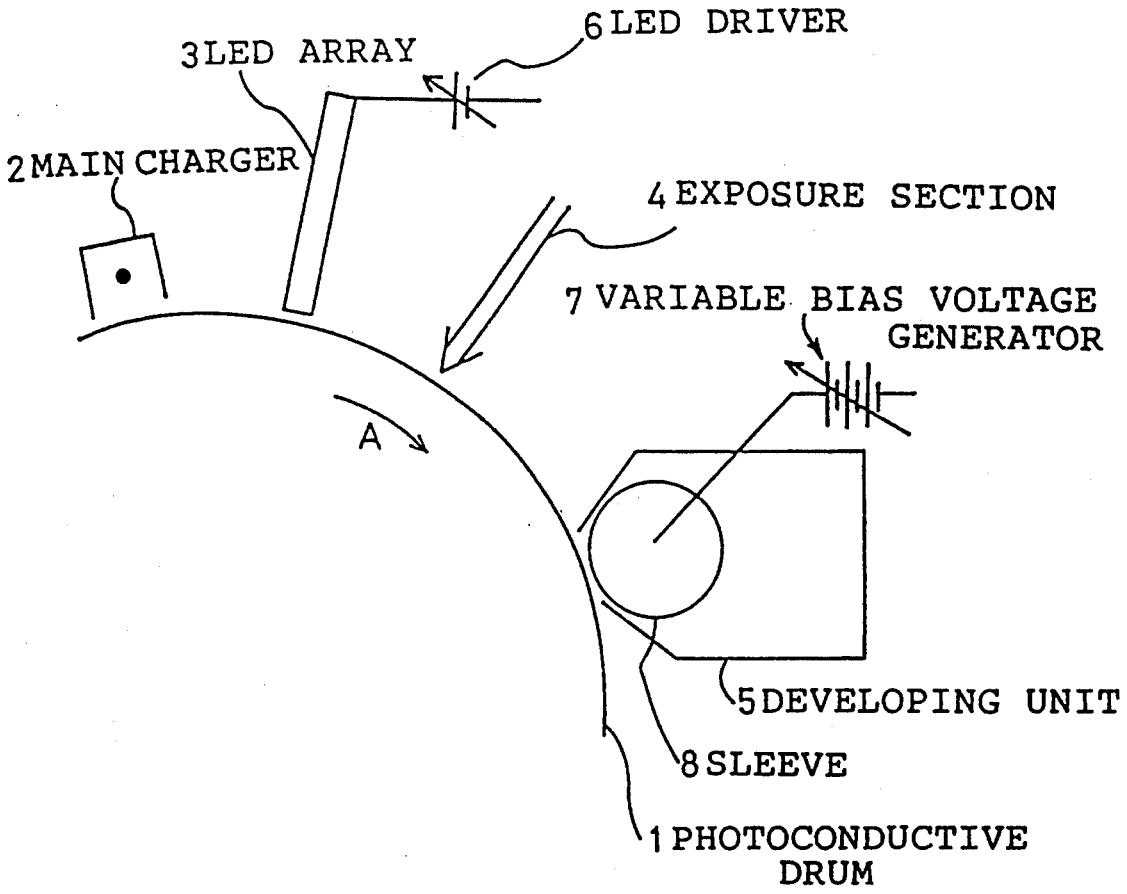
FIG. 1 is a cross-sectional view illustrating a photoconductive drum and components surrounding the drum of a copying machine of the embodiment.
Figure 2:
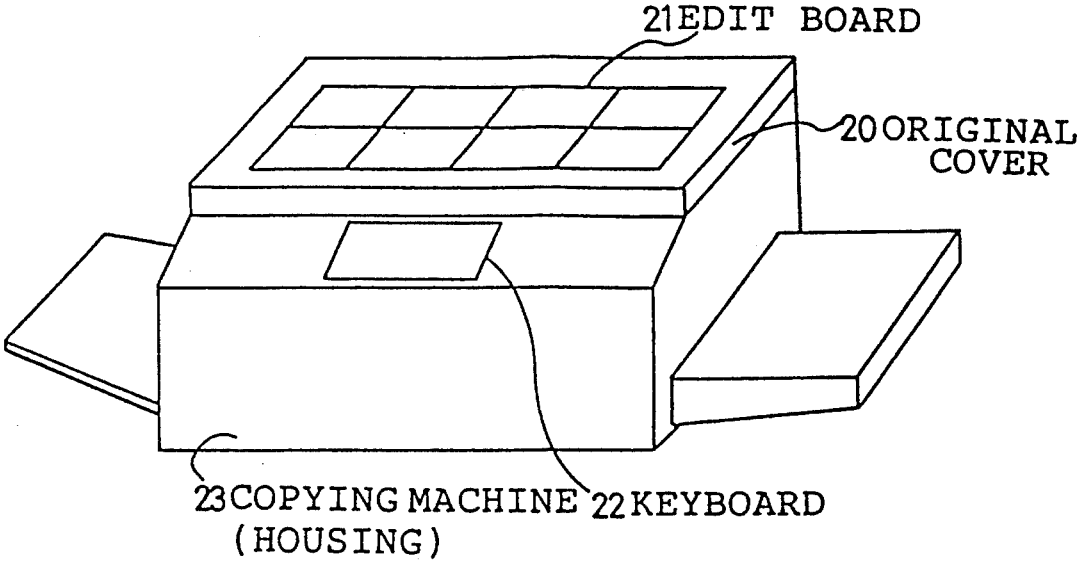
FIG. 2 is a perspective view of the copying machine of the embodiment.

The present invention is embodied in an analog electrostatic copying machine using two-component developer. The invention can also be applied to a digital copying machine. As shown in FIG. 1, around a photoconductive drum 1 are placed (along the rotation direction A): a main charger 2; an array of light emitting diodes (LED array) 3; an exposure (image imposing) section 4; and a developing unit 5. The LED array 3 receives electrical current from an LED driver 6 whose voltage is variable (thus the LED driver 6 acts as the light amount changing means in the claims). In the developing unit 5 is provided a rotatable sleeve 8 near and parallel to the drum 1. An optimal bias voltage is applied to the sleeve 8 from a variable bias voltage generator 7.

The photoconductive drum 1 and the main charger 2 are of a form used in conventional copying machines. For example, the photoconductive material of the drum surface can be made of selenium type material or organic photoconductive material, and the main charger 2 can be a scorotron type. Of course, other material or other types of chargers can be used.

Figure 5:
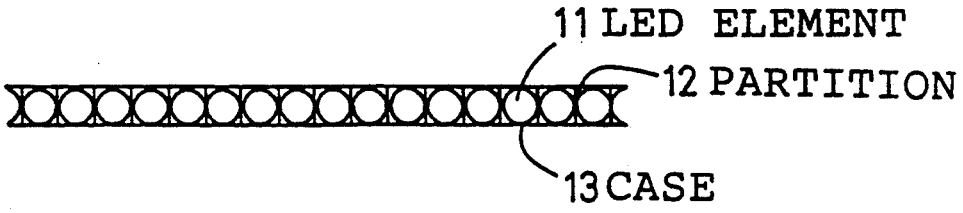
FIGS. 5–7 are examples of construction of an LED array for decreasing the surface voltage of the photoconductive drum.
Figure 6:
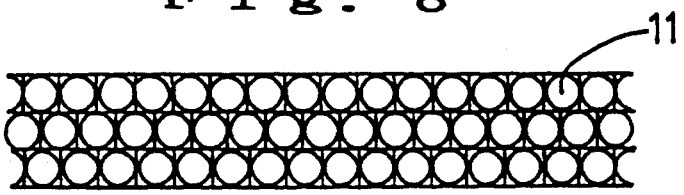
Figure 7:
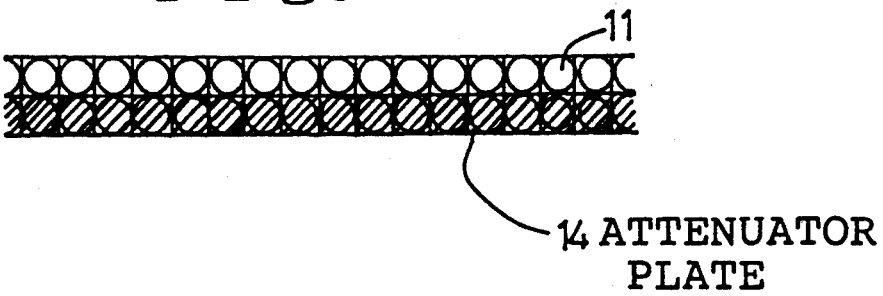

Several examples of the construction of the LED array 3 are shown in FIGS. 5–7. The one shown in FIG. 5 is a simple linear array of LED elements 11 contained in a long case 13 with a partition 12 between neighboring elements. When the drum 1 charged at a predetermined voltage (the predetermined voltage is referred to as "full voltage" hereinafter, but the main charger can charge the drum higher than the full voltage) is irradiated by the light from the LED array 3, the voltage of the drum 1 decreases from the full voltage. The value of the full voltage is usually between 300 to 1000 V. By controlling the amount of radiation from the LED array 3, the surface voltage of the drum 1 can be controlled. The amount of radiation from the LED array 3 can be changed by changing the voltage of the driving current from the LED driver 6.

A so-called blank lamp is used in some of conventional copying machines to erase a part of the copy image. But the blank lamp itself is not suited in this invention. One reason is that the blank lamp is designated to completely erase the surface voltage of the photoconductive drum. Another reason is that LED elements of a blank lamp are more dispersed than as described in FIG. 5. In such a case, even if the driving voltage of the LED elements of the blank lamp is decreased to irradiate a less intense light, a shadow of the partitions 12 appears on the drum and the radiation intensity may not be uniform throughout the irradiated area. That is why the LED elements 11 are closely packed in the LED array 3 of the present embodiment. Therefore, a more preferable configuration of the LED array 3 is, as shown in FIG. 6, a two-dimensional array. In FIG. 6, three closely packed linear arrays of LED elements 11 are piled three fold with the partitions of neighboring piles dislocated half-pitch. Another variation of the LED array 3 is shown in FIG. 7. At least two linear arrays of LED elements 11 are piled and at least one linear array can be covered with an attenuator plate 14 which decreases the intensity of the passing light. When all the LED elements 11 are uncovered, the LED array can be used as a blank lamp, and when a part or all of the LED elements 11 are covered with the attenuator plate 14, it can be used for decreasing the surface voltage. Of course a blank lamp and an LED array 3 for decreasing the surface voltage for altering gradation can be provided separately.

The image of the original is transmitted through an optical system and is focused on the drum 1 at the exposure section 4, whereby a latent image is produced on the drum 1. In the digital copying machine or a printer, an intensity-modulated laser beam is scanned across the drum to make the latent image. In the developing unit 5 is contained developer which is a mixture of toner powder and magnetic carrier powder. The developer is attracted onto the surface of the sleeve 8 by a magnet placed within the sleeve 8 and makes magnetic brush on the surface. The toner in the developer is transferred from the sleeve 8 to the drum 1 by the electrostatic force, because the toner is charged negative and the drum surface is charged positive. The amount of toner transferred from the sleeve 8 to the drum 1 depends on the bias voltage applied to the sleeve 8. Therefore, the toner image of desired density (overall density) can be obtained on the drum 1 by altering the bias voltage using the variable bias voltage generator 7.

An edit board 21 is provided on the original cover plate 20, and a keyboard 22 is provided on the slanted front panel of the housing 23 of the copying machine. The edit board 21 is used to designate a part or parts of the original in which the gradation characteristic is changed from the other part. A digitizer used in some of conventional copying machines to designate an area of the image to be erased (i.e., for masking or trimming a copy image) can be used as the edit board 21 of the present embodiment.

Figure 3:
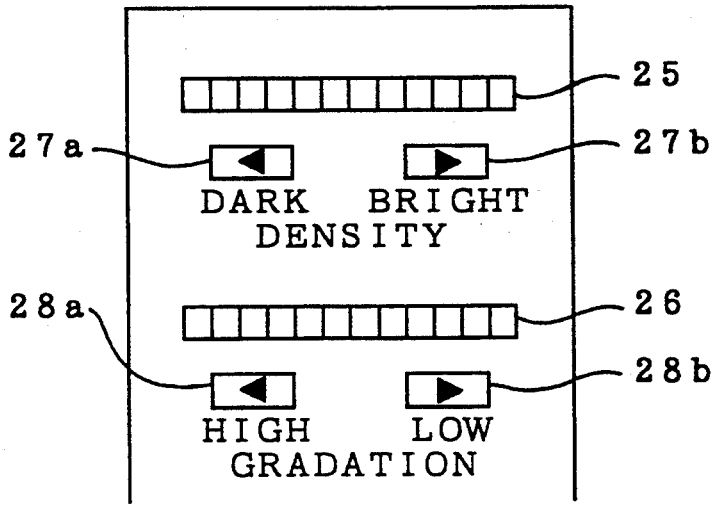
FIG. 3 is a plan view of the operation panel of the copying machine.

The keyboard 22, as shown in FIG. 3, has a pair of density setting keys 27*a* and 27*b*, a brick display 25 for indicating the set density value, a pair of gradation setting keys 28*a* and 28*b* and a brick display 26 for indicating the set gradation value. The gradation setting keys 28*a* and 28*b* are provided for setting the gradation characteristic of the copy image in the area designated by the edit board 21.

The overall density of the whole copy image is changed by changing the bias voltage applied to the sleeve 8 by the variable bias voltage generator 7. When the operator presses the left side key (DARK key) 27*a* of the density setting keys, the bias voltage is lowered and subsequently the amount of toner transferred from the sleeve 8 to the drum 1 increases, resulting in a darker copy image. When the opposite key (BRIGHT key) 27*b* is pressed, the bias voltage is raised and the toner is more strongly attached to the sleeve 8, resulting in a brighter copy image. The overall density of the whole copy image can be changed otherwise. When the strength of the lamp illuminating the original is changed, the amount of light imposed on the drum surface at the exposure section 4 changes and the density of the whole copy image changes.

The gradation characteristic of the area designated by the edit board 21 is changed by changing the amount of light irradiated from the LED array 3 to the drum surface. The amount of irradiating light can be changed by changing the voltage of the driving current supplied from the LED driver 6 to the LED array 3. When the left side key (HIGHer gradation key) 28*a* of the gradation setting keys is pressed, the voltage of the driving current given from the LED driver 6 to the LED elements of the LED array 3 increases and subsequently more amount of light is irradiated from the LED array 3 to the drum surface (within the designated area). The surface voltage of the drum 1 then decreases by the irradiation and the gradation becomes higher in the area. When the opposite key (LOWer gradation key) 28*b* is pressed, the voltage of the drive current to the LED array 3 decreases and also the amount of light irradiated in the area becomes less. This causes less decrease in the surface voltage of the drum 1 and results in the lower gradation of the copy image. The amount of decrease in the drum surface voltage is preferably between 10 to 60%, i.e., the resultant surface voltage is preferably between 40 to 90% of the full voltage (300–1000 V), to obtain an overall clear image in both a text part and in a photograph part. The values cited here is for the surface voltage when the designated area of the drum 1 comes to the developing unit 5, i.e. the value includes the spontaneous decrease during the drum rotation.

The copying process for an original including a text part and a photograph part using the present embodiment is now explained. First the original is placed on the edit board 21 to facilitate the designation of the area. In this embodiment, the photograph area (one or more) that requires a gentle gradation slope copy image (i.e., lower gradation characteristic) is designated by the edit board 21. After finishing the area designation, the cover plate 20 is opened and the original is placed on a contact glass at the top of the housing 23 of the copying machine. Before starting a copying operation, the density setting key 27*a* or 27*b* is operated to set the overall density of the copy image at an appropriate level. Then the overall density setting is made appropriate for the text part (i.e., the area not designated by the edit board 21) by using the density setting keys 27*a* and 27*b*. Then the gradation characteristic of the photograph part is determined by using the gradation setting keys 28*a* and 28*b* as described above.

When the copy start button on the front panel (not shown) is pressed, the main charger 2 turns on and the drum 1 starts rotating in the direction A. The photoconductive surface of the drum 1 is charged at the full voltage (800 V in this case) by the main charger 2. An area of the drum surface corresponding to the previously designated area (photograph part) is irradiated by a certain amount of light from the LED array 3, and the surface voltage of that area decreases from the full voltage. Here the surface voltage of the irradiated area is supposed to become 600 V. The value of the decreased surface voltage has been determined by the operation of the gradation setting keys 28*a* and 28*b*.

Figure 4:
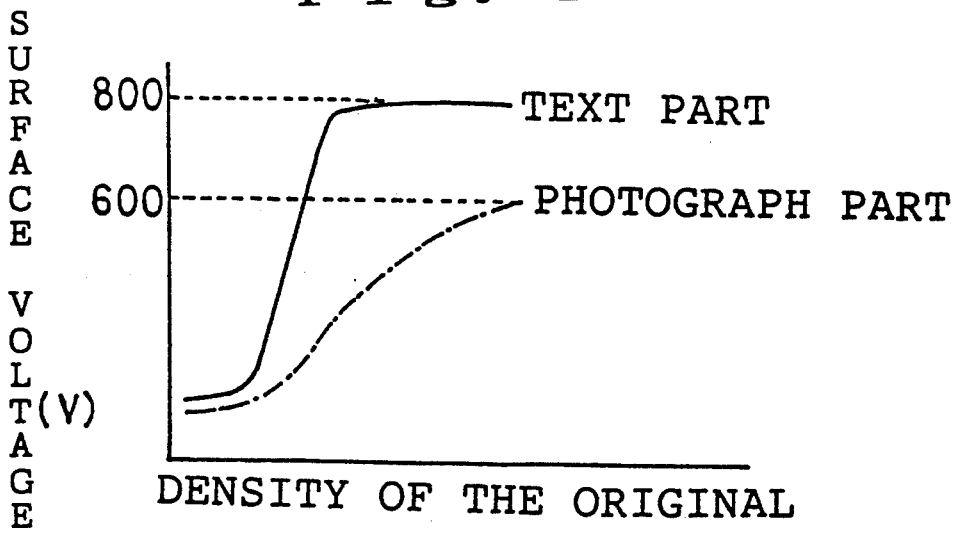
FIG. 4 is a graph showing the difference in the maximum surface voltage and gradation characteristic between a text part and a photograph part.

Then a latent image is produced on the drum surface at the exposure section 4. As illustrated in FIG. 4, the surface voltage of the photograph part changes gradually as the density of the original changes, while the surface voltage of the text part changes sharply. This means that the γ-value (i.e., the slope of the curve) is small in the photograph part and large in the text part. When the latent image is developed with the toner transfer at the developing unit 5, since lower surface voltage of the drum surface attracts less toner at the developing unit 5, the maximum density of the photograph part is lower than the text part. These make the high gradation and low maximum density copy image of the photograph part. The density of the text part is according to the value set by the density setting keys 27*a* and 27*b*.

In summary, an area of the original is designated beforehand and the surface voltage of the photoconductive drum corresponding to the designated area is decreased. Then the normal copying operation is performed to obtain a copy image with different gradation characteristic in the text part and in the photograph part. Because the copying operation is performed only once in the present embodiment, the copying time (speed) is the same as in the conventional normal copying machine, and no displacement between the text part and photograph part occurs. If the conventional blank lamp is used as the LED array of the above embodiment as described above, the copying machine according to the present invention can be compact and low-cost. The definition of the photograph part (i.e., division of the original into the text part and the photograph part) is very easy by using the edit board.

What is claimed is:

1. An image recording machine in which a latent image corresponding to an original to be recorded is produced on a photoconductive material previously charged to a full voltage and the latent image is made visible by a developer, the image recording machine comprising:

means for designating a specific area of an original; and voltage decreasing means for decreasing the voltage of the photoconductive material within an area corresponding to a designated specific area;

wherein said voltage decreasing means includes an array of light emitting diode elements contained in a long case having partitions which are closely arranged, such that a shadow does not appear on the photoconductive material when less intense light is emitted by said array of light emitting diode elements and wherein said array of light emitting diode elements comprises a plurality of linear light emitting diode arrays which are folded such that said partitions of neighboring light emitting diode arrays are displaced by half-pitch.

2. An image recording machine in which a latent image corresponding to an original to be recorded is produced on a photoconductive material previously charged to a full voltage and the latent image is made visible by a developer, the image recording machine comprising:

means for designating a specific area of an original; and voltage decreasing means for decreasing the voltage of the photoconductive material within an area corresponding to a designated specific area;

wherein said voltage decreasing means includes an array of light emitting diode elements contained in a long case having partitions which are closely arranged, such that a shadow does not appear on the photoconductive material when less intense light is emitted by said array of light emitting diode elements and wherein said array of light emitting diode elements comprises a plurality of linear light emitting diode arrays which are packed such that said partitions neighboring light emitting diode arrays are displaced by half-pitch.

3. An image recording machine in which a latent image corresponding to an original to be recorded is produced on a photoconductive material previously charged to a full voltage and the latent image is made visible by a developer, the image recording machine comprising:

means for designating a specific area of an original; and voltage decreasing means for decreasing the voltage of the photoconductive material within an area corresponding to a designated specific area;

wherein said voltage decreasing means includes an array of light emitting diode elements covered with an attenuator plate which reduces the intensity of passing light and wherein said array of light emitting diode elements is folded with another array of light emitting diode elements not covered with an attenuator plate.

4. An image recording machine in which a latent image corresponding to an original to be recorded is produced on a photoconductive material previously charged to a full voltage and the latent image is made visible by a developer, the image recording machine comprising:

means for designating a specific area of an original; and voltage decreasing means for decreasing the voltage of the photoconductive material within an area corresponding to a designated specific area;

wherein said voltage decreasing means includes an array of light emitting diode elements covered with an attenuator plate which reduces the intensity of passing light and wherein said array of light emitting diode elements is packed with another array of light emitting diode elements not covered with an attenuator plate.

5. An electrostatic copying machine comprising:

means for designating a specific area of an original to be copied;

means for charging the surface of a photoconductive drum to a predetermined full voltage;

means for decreasing the surface voltage of the photoconductive drum within an area corresponding to a designated specific area from the full voltage;

means for producing a latent image on the surface of the photoconductive drum according to the original; and means for electrostatically transferring toner to the surface of the photoconductive drum to develop a latent image, wherein said surface voltage decreasing means is an array of light emitting diode elements recepted in a long case having partitions which are closely arranged so that a shadow does not appear on the photoconductive material when less intense light is emitted by said array of light emitting diode elements and wherein said array of light emitting diode elements comprises a plurality of linear light emitting diode arrays which are folded so that partitions of neighboring light emitting diode arrays are displaced by half-pitch.

6. An electrostatic copying machine comprising:

means for designating a specific area of an original to be copied;

means for charging the surface of a photoconductive drum to a predetermined full voltage;

means for decreasing the surface voltage of the photoconductive drum within an area corresponding to a designated specific area from the full voltage;

means for producing a latent image on the surface of the photoconductive drum according to the original; and means for electrostatically transferring toner to the surface of the photoconductive drum to develop a latent image, wherein said surface voltage decreasing means is an array of light emitting diode elements recepted in a long case having partitions which are closely arranged so that a shadow does not appear on the photoconductive material when less intense light is emitted by said array of light emitting diode elements wherein said array of light emitting diode elements comprises a plurality of linear light emitting diode arrays which are packed so that partitions of neighboring light emitting diode arrays are displaced by half-pitch.

7. An electrostatic copying machine comprising:

means for designating a specific area of an original to be copied;

means for charging the surface of a photoconductive drum to a predetermined full voltage;

means for decreasing the surface voltage of the photoconductive drum within an area corresponding to a designated specific area from the full voltage;

means for producing a latent image on the surface of the photoconductive drum according to the original; and means for electrostatically transferring toner to the surface of the photoconductive drum to develop a latent image, wherein said surface voltage decreasing means is an array of light emitting diode elements recepted in a long case having partitions which are closely arranged so that a shadow does not appear on the photoconductive material when less intense light is emitted by said array of light emitting diode elements, wherein surface voltage decreasing means is an array of light emitting diode elements covered with an attenuator which reduces the intensity of passing light, and wherein said array of light emitting diode elements is folded with another array of light emitting diode elements not covered with an attenuator plate.

8. An electrostatic copying machine comprising:

means for designating a specific area of an original to be copied;

means for charging the surface of a photoconductive drum to a predetermined full voltage;

means for decreasing the surface voltage of the photoconductive drum within an area corresponding to a designated specific area from the full voltage;

means for producing a latent image on the surface of the photoconductive drum according to the original; and means for electrostatically transferring toner to the surface of the photoconductive drum to develop a latent image, wherein said surface voltage decreasing means is an array of light emitting diode elements recepted in a long case having partitions which are closely arranged so that a shadow does not appear on the photoconductive material when less intense light is emitted by said array of light emitting diode elements wherein surface voltage decreasing means is an array of light emitting diode elements covered with an attenuator which reduces the intensity of passing light, and wherein said array of light emitting diode elements is packed with another array of light emitting diode elements not covered with an attenuator plate.

* * * * *